United States Patent [19]

Jobson

[11] Patent Number: 4,924,760

[45] Date of Patent: May 15, 1990

[54] ROOF VENT DAMPER

[76] Inventor: Harvey E. Jobson, 2414 Rosedown Dr., Reston, Va. 22091

[21] Appl. No.: 377,075

[22] Filed: Jul. 10, 1989

[51] Int. Cl.[5] ..... F24F 11/00

[52] U.S. Cl. ..... 98/42.15; 29/890.126; 98/86; 137/77; 251/329

[58] Field of Search ..... 29/157.1 R; 98/1, 42.03, 98/42.15, 86; 137/72, 74, 77; 251/326, 366

[56] References Cited

U.S. PATENT DOCUMENTS

| | | | |
|---|---|---|---|
| 2,183,645 | 12/1939 | Hansen . | |
| 2,218,926 | 10/1940 | Teichmann . | |
| 2,285,829 | 6/1942 | Maage, Jr. | 251/11 |
| 2,923,225 | 2/1960 | Massey . | |
| 4,759,270 | 7/1988 | Lindeen | 95/2.14 |

FOREIGN PATENT DOCUMENTS

| | | | |
|---|---|---|---|
| 2412437 | 9/1975 | Fed. Rep. of Germany | 98/86 |
| 2233549 | 1/1975 | France | 98/86 |
| 2338091 | 8/1977 | France | 98/86 |

*Primary Examiner*—Harold Joyce
*Attorney, Agent, or Firm*—Jerry T. Kearns

[57] ABSTRACT

A roof vent damper for closing a roof mounted ventilator in the event of a fire includes a frame formed from an elongated rectangular plate having a central dumbbell shaped cut-out. Longitudinal side edges of the plate are folded over to form parallel guide track members. The plate is then folded along a central transverse line extending across a narrow central portion of the cut-out to form overlying plate members separated by a hollow guide track. A damper plate is received for reciprocal sliding movement in the guide track and is retained in an open position by a fusible link which separates at a predetermined elevated temperature. The damper is biased to a closed position by a coil spring.

6 Claims, 3 Drawing Sheets

ROOF VENT DAMPER

BACKGROUND OF THE INVENTION

1. Field of the Invention

The present invention relates to roof vent dampers, and more particularly pertains to a roof vent damper for automatically closing a roof mounted vent in the event of a fire. Many industrial buildings and houses are equipped with wind driven roof mounted attic ventilators for circulating air through the building attic. While these ventilators are effective during the summer months to reduce air conditioning energy expenditures, these vents create a hazard in the event of fire. In order to overcome this problem, the present invention provides an automatic damper to close the ventilator opening in the event of a fire in order to reduce the supply of oxygen to the fire.

2. Description of the Prior Art

Various types of roof vent dampers are known in the prior art. A typical example of such a roof vent damper is to be found in U.S. Pat. No. 2,183,645, which issued to R. Hansen on Dec. 19, 1939. This patent discloses a roof vent having a pivotal damper plate operable from a remote location through a rope and pulley mechanism. U.S. Pat. No. 2,218,926, which issued to H. Teichmann on Oct. 22, 1940, discloses a damper system for an industrial building roof which utilizes a pair of pivotal opposed dampers. U.S. Pat. No. 2,285,829, which issued to A. Maage Jr. on June 9, 1942, discloses a damper regulator for a rectangular cross section ventilation duct which is formed as a pivotally mounted rectangular plate. The damper includes a regulator for manually adjusting the damper position. U.S. Pat. No. 2,923,225, which issued to C. Massey on Feb. 2, 1960, discloses a roof ventilator having a pivotal damper plate which is biased to an open position by a counter weight and is manually closable by a rope. U.S. Pat. No. 4,759,270, which issued to J. Lindeen on July 26, 1988, discloses a vent cap cover for a recreational vehicle vent including a pivotal damper.

While the above mentioned devices are directed to roof vent dampers, none of these devices disclose a damper which is automatically closed by separation of a fusible link at an elevated temperature to provide a fire safety measure. Additionally, none of the aforementioned devices disclose a method of forming an automatic roof vent damper by providing a dumbbell shaped cut-out in a sheet metal plate and folding the plate along a transverse central fold line to form an interior linear guide track for a damper plate. Inasmuch as the art is relatively crowded with respect to these various types of roof vent dampers, it can be appreciated that there is a continuing need for and interest in improvements to such roof vent dampers, and in this respect, the present invention addresses this need and interest.

SUMMARY OF THE INVENTION

In view of the foregoing disadvantages inherent in the known types of roof vent dampers now present in the prior art, the present invention provides an improved roof vent damper. As such, the general purpose of the present invention, which will be described subsequently in greater detail, is to provide a new and improved roof vent damper which has all the advantages of the prior art roof vent dampers and none of the disadvantages.

To attain this, a representative embodiment of the concepts of the present invention is illustrated in the drawings and makes use of a roof vent damper for closing a roof mounted ventilator in the event of a fire including a frame formed from an elongated rectangular plate having a central dumbbell shaped cut-out. Longitudinal side edges of the plate are folded over to form parallel guide track members. The plate is then folded along a central transverse line extending across a narrow central portion of the cut-out to form overlying plate members separated by a hollow guide track. A damper plate is received for reciprocal sliding movement in the guide track and is retained in an open position by a fusible link which separates at a predetermined elevated temperature. The damper is biased to a closed position by a coil spring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roof vent damper which has all the advantages of the prior art roof vent dampers and none of the disadvantages.

It is another object of the present invention to provide a new and improved roof vent damper which may be easily and efficiently manufactured and marketed.

It is a further object of the present invention to provide a new and improved roof vent damper which is of a durable and reliable construction.

An even further object of the present invention is to provide a new and improved roof vent damper which is susceptible of a low cost of manufacture with regard to both materials and labor, and which accordingly is then susceptible of low prices of sale to the consuming public, thereby making such roof vent dampers economically available to the buying public.

Still yet another object of the present invention is to provide a new and improved roof vent damper which provides in the apparatuses and methods of the prior art some of the advantages thereof, while simultaneously overcoming some of the disadvantages normally associated therewith.

Still another object of the present invention is to provide a new and improved roof vent damper which includes an automatic closing mechanism actuated in the event of fire.

Yet another object of the present invention is to provide a new and improved roof vent damper which is automatically closed in the event of fire through the separation of a fusible link.

Even still another object of the present invention is to provide a new and improved roof vent damper for closing a wind driven roof vent during winter months.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
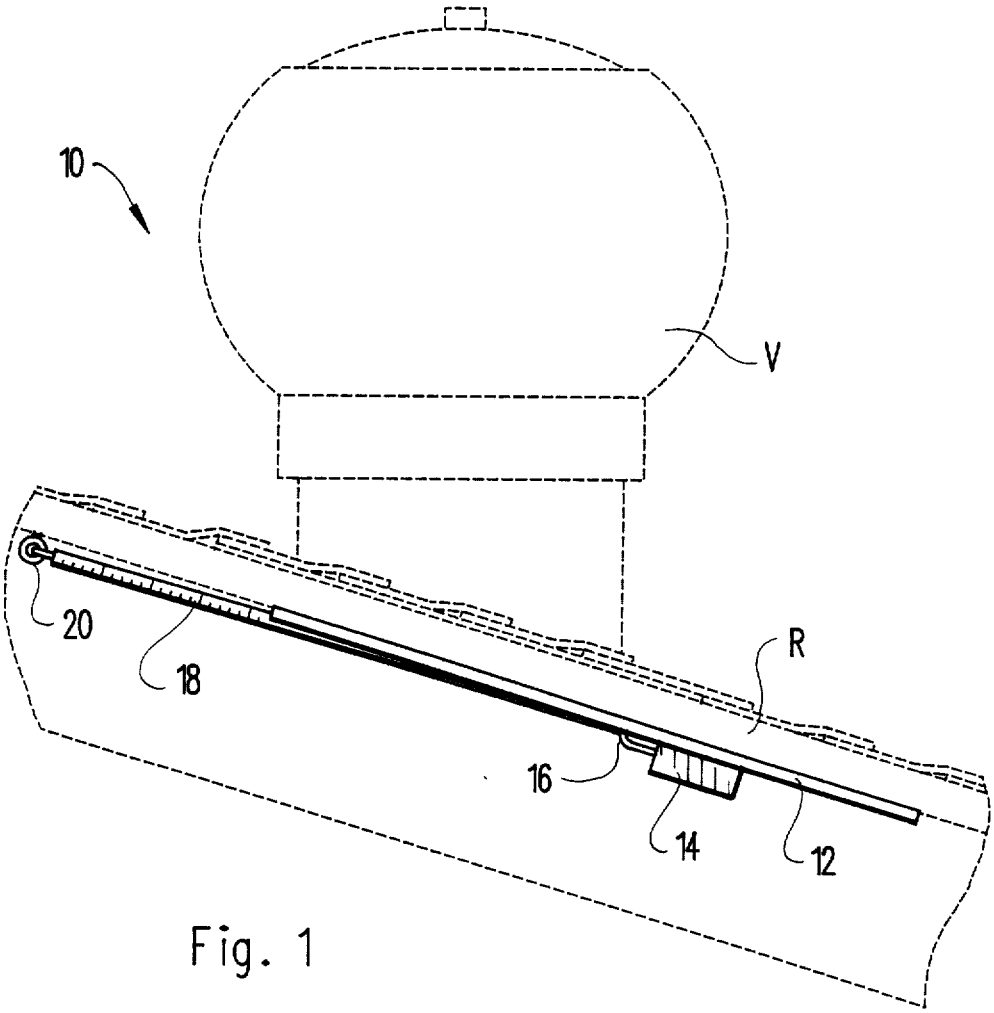
FIG. 1 is a diagrammatic elevational view illustrating the roof vent damper of the present invention installed in conjunction with a conventional roof vent.

With reference now to the drawings, and in particular to FIG. 1 thereof, a new and improved roof vent damper embodying the principles and concepts of the present invention and generally designated by the reference numeral 10 will be described.

More specifically, it will be noted that the first embodiment 10 of the invention includes a frame plate 12 secured on an interior surface of a building roof R. An opening in the plate 12 is disposed in registry with the vent aperture formed through the roof R and communicating with the conventional wind driven attic ventilator V. While the roof vent damper may be utilized with a variety of roof vents, it is particularly suited for use with the conventional wind driven ventilator which includes a plurality of rotary vanes to circulate air through the attic of a home or building. A damper plate (not shown) is received for linear sliding movement along the frame plate 12 and is secured in an open position by a pin 16 which extends through a hole in the damper plate. The pin 16 is secured by a fusible link within a housing 14 on a surface of the frame plate 12. A coil spring 18 has one end secured to the damper plate and an opposite end secured by an eye bolt 20 to a stationary mounting surface on the roof R. Thus, the spring 18 biases the damper plate to a closed position. The fusible link within the housing 14 is of the type utilized in fire safety doors and is designed to separate at a predetermined elevated temperature. Preferably, a fusible link having a one hundred sixty degree fahrenheit separation rating is employed. This form of fusible link has a load carrying capacity of approximately eight pounds below the rated separation temperature. The coefficient of the spring 18 is correspondingly selected.

Figure 2:
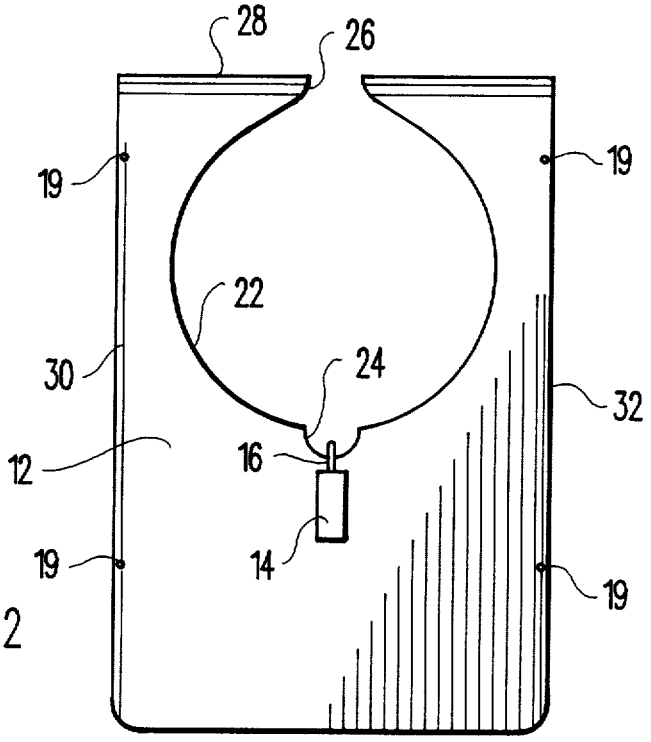
FIG. 2 is a plan view illustrating the roof vent damper.

FIG. 2 is a plan view which illustrates the frame plate 12. The damper frame is formed from an elongated rectangular sheet metal plate, preferably twenty-eight gage galvanized steel, which is provided with a centrally located dumbbell shaped cutout. The plate is then folded along a transverse central fold line 28, adjacent a narrow central portion 26 of the cut-out to form two overlying plate members, one of which is illustrated at 12. This provides a generally circular aperture 22 which may be formed in a variety of different diameters for use with different sized roof vents. An arcuate notch 24 is formed through both the overlying plate members and intersects the circular aperture 22. The right angular pin member 16 extends through the notch 24 for registry with a hole provided on a slidable damper plate. The opposite end of the pin 16 is secured within a hollow box shaped housing 14 by a fusible link member. A narrow edge portion along each longitudinal side edge of the plate 12 is folded under to form parallel guide track members 30 and 32. A plurality of mounting holes 19 are formed through the plate 12 for receiving fastening members for securing the frame plate 12 in a stationary location on an interior roof surface.

Figure 3:
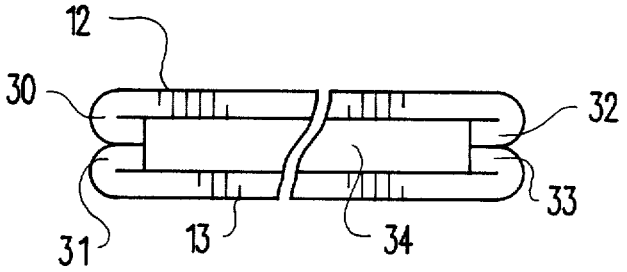
FIG. 3 is an elevational end view illustrating the construction of the frame of the roof vent damper.

FIG. 3 is an end elevational view of the damper frame which illustrates the overlying plate members 12 and 13. The narrow folded edges 30, 31, 32 and 33 form abutting guide track members defining an enclosed hollow guide track 34 between the plates 12 and 13.

Figure 4:
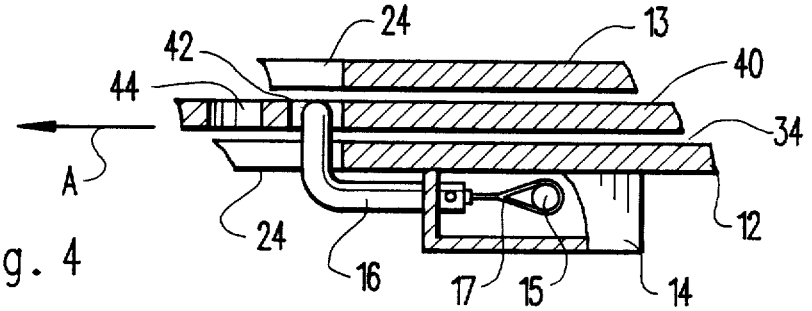
FIG. 4 is a partial cross sectional detail view illustrating the fusible link retaining mechanism for securing the damper in an open position.

As illustrated in FIG. 4, a generally rectangular damper plate 40 is received for linear reciprocal sliding movement within the guide channel 34, between the plates 12 and 13. The pin 16 has a free end portion received within a circular hole 42 formed through the damper plate 40. An opposite end of the pin 16 extends through a circular bore in an end wall of the housing 14 and is secured by a fusible link 17 to a stationary lug 15. One end of the coil spring 18 illustrated in FIG. 1 is secured within an aperture 44 provided in the damper 40 and serves to bias the damper plate 40 toward a closed position in the direction of the arrow A. Thus, when a predetermined elevated temperature is reached due to a fire, the fusible link 17 separates, releasing the pin 16 from securement within the housing 14. The release of the fusible link 17 allows the coil spring 18 (FIG. 1) to move the damper plate 40 to a closed position, thus reducing the supply of oxygen to the fire. This is especially critical in attic fires where the only major source of supplied oxygen may be through an open roof ventilator aperture.

Figure 5:
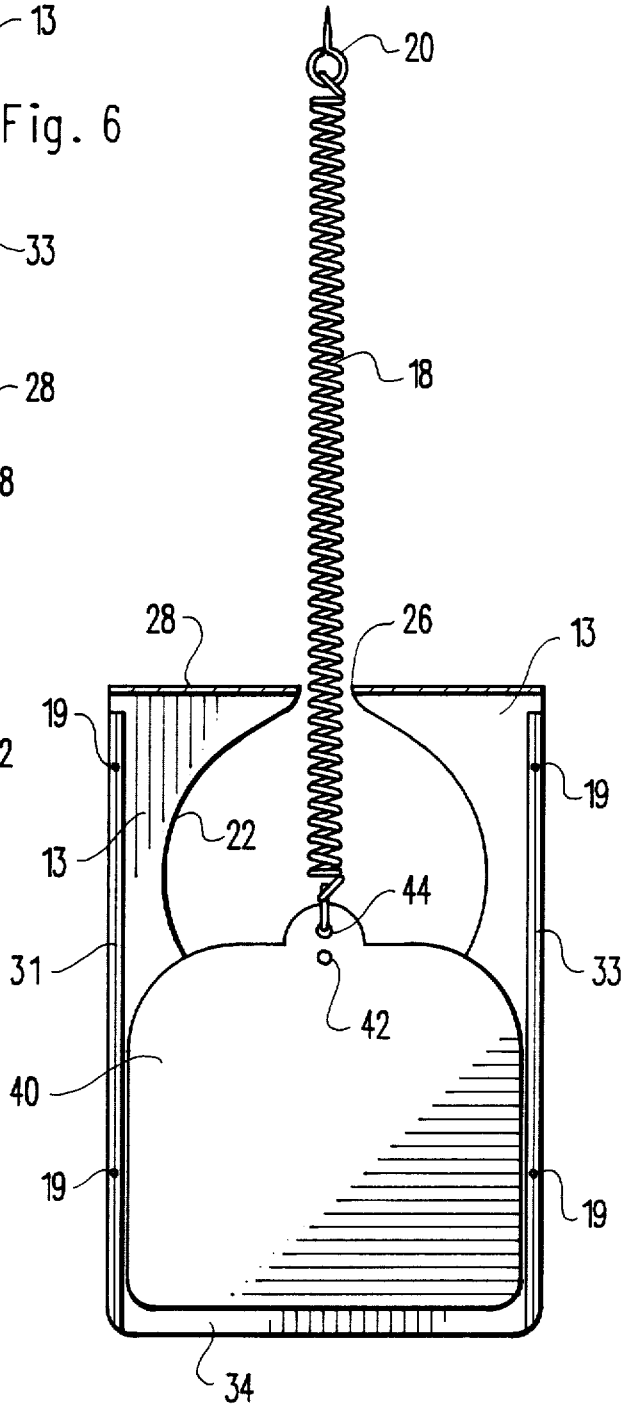
FIG. 5 is a cross sectional view illustrating the damper plate received for reciprocal linear movement in a frame guide track.

FIG. 5 is a plan view illustrating the roof vent damper, with the frame plate 12 cut away. The damper plate 40 is dimensioned to be received between the guide track members 31 and 33, within the guide channel 34. A circular hole 42 is provided for engagement with the retaining pin 16 shown in FIG. 4 and an additional spaced circular hole 44 is provided for securement of one end portion of the coil spring 18. An eye bolt or screw 20 may be utilized to secure an opposite end portion of the spring 18 to a stationary mounting surface on an interior roof portion within a building attic. The spring 18 is received through the central narrow portion 26 of the dumbbell shaped cut-out formed in the overfolded plate members.

Figure 6:
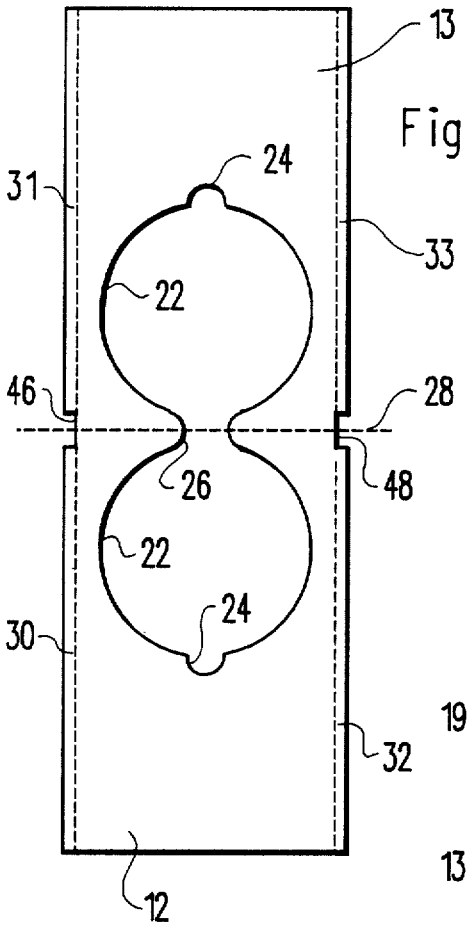
FIG. 6 is a plan view illustrating a method of forming the roof vent damper of the present invention.

FIG. 6 is a plan view illustrating a sheet metal blank utilized in the method of forming the roof vent damper of the present invention. A generally rectangular elongated sheet metal plate is provided with a centrally located dumbbell shaped cutout having a narrow central portion 26 connecting generally circular portions 22. Arcuate notches 24 are provided at opposite ends of the cut-out. Two aligned notches 46 and 48 are formed in opposite longitudinal side edges of the plate in alignment with the central narrow dumbbell cut-out portion 26. A narrow width portion along each of the longitudinal side edges of the plate is then folded under and secured by spot welding to form the guide track members 30, 31, 32 and 33. The plate is then folded along a transverse fold line 28 extending across the central narrow cut-out portion 26 to form two overlying plate members 12 and 13 enclosing a guide channel 34 as shown in FIG. 3. The damper plate 40 is then mounted within the guide channel 34 as shown in FIG. 5 and the coil spring 18 is secured to the damper plate 40. The fusible link housing 14 including the retaining pin 16 may then be secured to the plate 12 through the use of a variety of conventional fastening means.

The retaining pin 16 may be manually disengaged from the hole 42 of the damper 40 to close the roof vent during winter months to save on energy costs.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of making a roof vent damper, comprising the steps of:
   - providing a generally rectangular elongated sheet metal plate;
   - forming a dumbbell shaped cut-out in a central portion of said plate;
   - forming two aligned notches in opposite longitudinal side edges in alignment with a central narrow portion of said cut-out;
   - folding a narrow width portion along each of said plate longitudinal side edges to form parallel guide track members;
   - securing said guide track members in said folded condition;
   - folding said plate along a transverse line extending across said central narrow portion of said cut-out to form two overlying plate members enclosing a hollow central guide channel;
   - providing a generally rectangular damper plate; and
   - mounting said damper plate in said guide channel.

2. The method of claim 1, further comprising the step of securing an elongated coil spring to said damper plate.

3. The method of claim 2, further comprising the step of securing said damper plate in an open position to one of said overlying plate members by a fusible link adapted to separate at a predetermined elevated temperature.

4. A roof vent damper, comprising:
   - frame means, said frame means formed from an elongated generally rectangular sheet metal plate provided with a generally dumbbell shaped cut-out portion;
   - said plate having opposed longitudinal side edges folded under to form parallel track members;
   - said plate folded along a central line transverse to said longitudinal side edges to form a hollow central guide track and an aperture dimensioned for registry with a vent opening in a roof;
   - a damper slidably received in said guide track for reciprocal linear movement between opened and closed positions for selectively closing said aperture;
   - biasing means biasing said damper toward said closed position; and
   - remaining means retaining said damper in said open position until a predetermined temperature is reached.

5. The roof vent damper of claim 4, wherein said biasing means comprises a coil spring having one end secured to said damper and an opposite end adapted for securement to a stationary mounting surface.

6. The roof vent damper of claim 4, wherein said retaining means comprises a pin member received through a hole in a said damper and secured by a fusible link to said frame means.

* * * * *